United States Patent [19]

Mullins et al.

[11] Patent Number: 4,806,310

[45] **Date of Patent: * Feb. 21, 1989**

[54] CORROSION INHIBITOR

[75] Inventors: Michael A. Mullins, Wayne; Peter A. Thomas, Budd Lake, both of N.J.

[73] Assignee: Drew Chemical Corporation, Boonton, N.J.

[ * ] Notice: The portion of the term of this patent subsequent to May 12, 2004 has been disclaimed.

[21] Appl. No.: 47,338

[22] Filed: May 7, 1987

Related U.S. Application Data

[63] Continuation-in-part of Ser. No. 745,311, Jun. 14, 1985, Pat. No. 4,664,884.

[51] Int. Cl.[4] ..... C23F 11/12; C23F 11/14; C23F 11/167

[52] U.S. Cl. ..... 422/13; 252/389.22; 252/389.54; 210/699; 210/700; 422/15; 422/16; 422/17

[58] Field of Search ..... 422/13, 15, 16, 17; 210/699, 700; 252/390, 392, 394, 396, 389.22, 389.54

[56] References Cited

U.S. PATENT DOCUMENTS

| | | | |
|---|---|---|---|
| 3,837,803 | 9/1974 | Carter et al. . | |
| 3,891,568 | 6/1975 | Nishio et al. | 252/389.54 X |
| 3,935,125 | 1/1976 | Jacob . | |
| 3,959,168 | 5/1976 | Germscheid et al. | 252/180 |
| 3,992,318 | 11/1976 | Gaupp et al. . | |
| 4,052,160 | 10/1977 | Cook et al. . | |
| 4,057,511 | 11/1977 | Bohnsack et al. . | |
| 4,105,581 | 8/1978 | Sexsmith . | |
| 4,217,216 | 8/1980 | Lipinski | 252/389.54 X |
| 4,246,103 | 1/1981 | Block et al. . | |
| 4,317,744 | 3/1982 | Levi . | |
| 4,351,796 | 9/1982 | Marshall | 422/15 |
| 4,406,811 | 9/1983 | Christensen et al. | 252/180 |
| 4,497,713 | 2/1985 | Geiger | 210/699 |
| 4,664,884 | 5/1987 | Mullins et al. | 422/13 |
| 4,719,083 | 1/1988 | Baker et al. | 252/389.54 X |

OTHER PUBLICATIONS

Materials Performance, "Corrosion Inhibiting Synergism by Triazoles in Aqueous Multimetal Systems", pp. 9–13, Cleveland O'Neal, Jr., et al, Jan. 1975.

*Primary Examiner*—Herbert B. Guynn
*Attorney, Agent, or Firm*—Walter H. Schneider

[57] ABSTRACT

A corrosion inhibitor for ferrous and non-ferrous aqueous systems comprising (a) a water soluble phosphonic acid or salt thereof, preferably an amino methylene phosphonic acid; (b) a phosphonocarboxylic acid, preferably a phosphonoalkane carboxylic acid; (c) an azole, preferably benzotriazole or tolyltriazole; and (d) a water soluble molybdate salt, preferably sodium molybdate.

2 Claims, No Drawings

CORROSION INHIBITOR

This application is a continuation-in-part of U.S. application Ser. No. 745,311 filed June 14, 1985, now U.S. Pat. No. 4,664,844.

BACKGROUND OF THE INVENTION

1. Field of the Invention

The present invention relates to corrosion inhibition. More particularly, the present invention relates to corrosion inhibition in aqueous systems. Still more particularly, the present invention relates to a composition and method for controlling corrosion in aqueous systems.

2. Description of the Prior Art

Numerous chemical additives and combinations of additives have been proposed for inhibiting corrosion in cooling systems in industrial manufacturing processes, commercial and institutional air condition systems and the like. Among such corrosion inhibitors may be mentioned such well known chemicals as chromates, zinc, nitrites, silicates, nitrates, polyphosphates and benzoates, among others. Currently, various phosphonic acids and phosphonocarboxylic acids are favored, either alone or in combination with each other, with or without other known corrosion inhibitors. For example, U.S. Pat. No. 4,246,103 discloses various phosphonic and diphosphonic acids as corrosion inhibitors while U.S. Pat. Nos. 4,052,160 and 4,057,511 claim the same function for various phosphonocarboxylic acids. A combination of a phosphonic acid and an orthophosphate as a corrosion inhibitor is disclosed in U.S. Pat. No. 3,837,803 while a scale inhibiting composition comprising a phosphonocarboxylic acid and polymaleic anhydride is disclosed in U.S. Pat. No. 4,351,796. Corrosion inhibiting combinations of a phosphonic acid and a phosphate, together with an acrylic or methacrylic polymer, are shown in U.S. Pat. Nos. 3,992,318 and 4,105,581, while U.S. Pat. No. 4,317,744 shows similar compositions in which the phosphate has been replaced with tolyltriazole, a particularly effective non-ferrous metal corrosion inhibitor.

More recently, U.S. Pat. No. 4,406,811 has disclosed a corrosion inhibiting composition for use in aqueous systems, particularly those having multiple metallurgies, comprising a combination of a triazole and an aliphatic mono- or di-carboxylic acid. Optionally, there may be incorporated in this composition as a scale inhibitor a combination of a diphosphonic acid and a phosphonocarboxylic acid. The scale inhibiting combination of the diphosphonic acid and the phosphonocarboxylic acid is disclosed in U.S. Pat. No. 3,959,168 as a sequestering agent for which a synergism is claimed.

Still more recently issued is U.S. Pat. No. 4,497,713 which discloses a corrosion and scale inhibiting composition comprising a water soluble zinc salt, a water soluble cellulose gum polymer material and a organo-phosphorous compound such as a phosphonocarboxylic acid. Optionally, an azole compound and/or a soluble molydate salt may be incorporated to enhance corrosion control.

SUMMARY OF THE INVENTION

In accordance with the present invention, it has now been discovered that the corrosion inhibiting composition of U.S. application Ser. No.745,311, now U.S. Pat. No. 4,664,844, comprising (a) a water soluble phosphonic acid, (b) a phosphonocarboxcylic acid and (c) a triazole is enhanced by the inclusion of a water soluble molybdate salt. As an optional embodiment of the invention, an anti-flocculant, e.g., a vinyl polymer, may also be incorporated in the composition.

DESCRIPTION OF THE PREFERRED EMBODIMENT

In accordance with the present invention, the first component of the composition is a water soluble phosphonic acid, or salt thereof, which may be represented by the following:

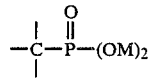

wherein each M is independently either hydrogen or a cation; e.g., a metal ion, including alkali metals, such as sodium, lithium, and potassium, alkaline earth metals, such as calcium and magnesium, aluminum, zinc, cadmium, and manganese; nickel, cobalt, cerium; lead, tin; iron, chromium and mercury; an ammonium ion; or an alkyl ammonium ion derived from amines having a low molecular weight, such as below 300, and more particularly, the alkyl amines, alkylene amines and alkanol amines containing no more than two amine groups, such as ethyl amine, diethyl amine, propyl-amine, propylene diamine, hexyl amine, 2-ethylhexylamine, N-butylethanol amine, triethanol amine and the like.

It is to be understood that as used herein the term "phosphonic acid" generically includes the phosphonic acid and the salts thereof.

As one type of phosphonic acid suitable for the purposes of the present invention, there may be mentioned the aminomethylene phosphonic acids which are characterized by the following grouping:

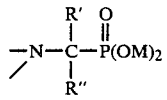

wherein M is hereinabove defined and R′ and R″ are each individually hydrogen or hydrocarbon (preferably $C_1$–$C_5$ alkyl).

The aminomethylene phosphonic acids are preferably characterized by the following structural formula:

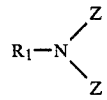

in which Z is

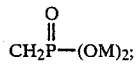

and $R_1$ is any of:

(1) Z

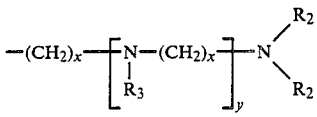

(2)

in which $R_2$ is Z, H, $CH_2COOM$ or $CH_2CH_2OH$
$R_3$ is Z, H or a $C_1$–$C_{20}$ alkyl
x is 1–20
y is 0–18
x+y is no more than 20

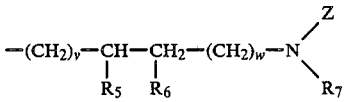

(3)

in which $R_5$ is H or OH
$R_6$ is H or alkyl, preferably of 1–6 carbons
$R_5$ and $R_6$ together are cyloalkyl, preferably of 4–6 carbons
$R_7$ is H or Z
v is 0–20
w is 0–20
v+w is no more than 20

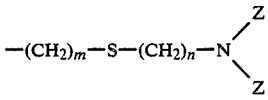

(4)

in which m and n are each 1–3
(5) $—R_8(OR_9)_r(OR_{10})$
in which $R_8$ is $C_3$–$C_5$ alkylene
$R_9$ is $C_2$–$C_5$ alkylene
$R_{10}$ is $C_1$–$C_5$ alkyl
r is 1–20

As a further type of aminomethylene phosphonic acid, there may be mentioned the silicon containing amino methylene phosphonic acids, as described in U.S. Pat. No. 3,716,569 which is hereby incorporated by reference.

As still another type of aminomethylene phosphonic acid, there may be mentioned the nitrogen-hetercyclic phosphonic acids characterized by aminomethylene phosphonic acids bonded directly or indirectly to the nitrogen atom of the heterocyclic ring, as disclosed in U.S. Pat. No. 3,674,804 which is hereby incorporated by reference.

As still another type of phosphonic acid which is suitable for the purposes of the present invention, there may be mentioned the ethane diphosphonic acids. The ethane diphosphonic acids are characterized by the following structural formula:

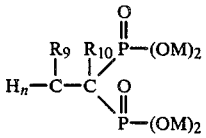

wherein M is as defined previously; n is 1 or 2 to provide the required number of hydrogen atoms; $R_9$ is either hydrogen, alkyl (preferably containing 1 to 4 carbon atoms), oxygen, halogen, hydroxy, cyano, $—(R_{11})_2$ wherein $R_{11}$ is hydrogen or alkyl containing 1–30 carbon atoms, $XR_{12}$ where X is sulfur or oxygen and $R_{12}$ is alkyl containing 1–30 carbon atoms, preferably 1–4 carbon atoms; phenyl, benzyl, acetoxy, $SO_3R_{11}$ wherein $R_{11}$ is as above, benzoyl, $CO_2H$ and $CH(COOR_{11})_2$ wherein $R_{11}$ is as defined above; $R_{10}$ is as above except for oxygen and alkyl, and $R_{10}$ is hydrogen when $R_9$ is oxygen, and one of $R_9$ and $R_{10}$ hydroxy, except that when $R_9$ is oxygen $R_{10}$ is hydrogen.

The ethane disphosphonic acids are disclosed in U.S. Pat. No. 3,644,151 which is hereby incorporated by reference.

As representative examples of phosphonic acids which may be employed in the corrosion inhibiting composition of the present invention, there may be mentioned ethane-1-hydroxy-1,1-diphosphonic acid, the preferred aminotrimethylene phosphonic acid, ethylenediaminetetramethylene phosphonic acid, hexamethylenediaminetetramethylene phosphonic acid; and the water soluble salts thereof.

The second component of the composition in accordance with this invention is a phosphonocarboxylic acid which may be represented by the following formula:

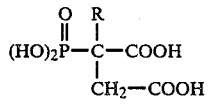

wherein R represents a hydrogen atom, an optionally substituted alkyl, alkenyl or alkinyl group, in each case having up to 4 carbon atoms, an aryl, cycloalkyl or aralkyl group or the group

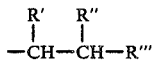

in which R′ represents hydrogen, an alkyl group having up to carbon atoms or a carboxyl group; R″ represents hydrogen or methyl; and R‴ represents a carboxyl group.

Examples of such phosphonoalkanecarboxylic acids are 1-phosphonopropane-dicarboxylic acid -2,3 and the preferred 2-phosphonobutane-tricarboxylic acid -1,2,4.

The third component of the composition of this invention is a triazole, specifically benzotriazole or tolyltriazole, the latter being preferred.

The fourth component of the composition of this invention is a water soluble molydate salt, e.g., an alkali metal or ammonium salt, preferably sodium molydate.

The four components of the composition are present in amounts which are effective to prevent or, at least, substantially reduce corrosion upon addition of the composition to a system subject to corrosion. In general, the composition comprises about 0.3–30% by weight phosphonic acid, about 0.4–40% by weight phosphonocarboxylic acid, about 0.4–40% by weight azole, about 0.5–50% molybdate salt and the balance water. Although the hereinabove described amounts of the components employed in the composition are preferred, the overall scope of the invention is not limited to such amounts. The choice of optimum amounts of the various components is deemed to be within the scope of those skilled in the art.

The composition of the present invention is generally employed in combination with a liquid vehicle, preferably water. It is to be understood, however, that the composition can also be employed in solid form, or that the components can be individually added to the aqueous system. In general, the composition is employed using water as a vehicle, with the components being added to the water to provide a concentration of the four components in the water of from about 1% to about 80%, and preferably from about 5% to about 40%, all by weight. The composition may also include other water treatment components, such as, defoamers, dispersants, biocides, etc. and accordingly, the addition of such components is within the scope of the present invention. A particularly desirable optional component is a polymeric anti-scalant. For this purpose, any of various vinyl polymers may be employed. A preferred polymer is a polyacrylamide offered by American Cyanamid Company under the trademark Cyanamer P-70 and having a molecular weight of approximately 1000.

The composition of the present invention containing corrosion inhibiting amounts of the hereinabove described four components is added to a system subject to corrosion in a corrosion inhibiting amount; i.e., in an amount which is effective to prevent corrosion in the system. This amount will vary depending upon the system to which the composition is added and is influenced by factors, such as area subject to corrosion, processing conditions (pH, temperature, water quantity, etc.). In general, the corrosion inhibitor is employed in the system in an amount to provide a concentration of the four components of at least 1 ppm and preferably at least 5 ppm. In most cases, the concentration of the four active components does not exceed 100 ppm, all by weight. The selection of optimum amounts of the four components for providing the desired corrosion inhibition is deemed to be well within the scope of those skilled in the art from the teachings herein.

The composition of the present invention is particularly suitable for inhibiting corrosion in aqueous systems. The corrosion inhibitor of the present invention is particularly effective for inhibiting corrosion of ferrous containing metals, and in particular, mild steel and, accordingly, has particular applicability to inhibiting corrosion in such cooling water systems using cycled waters without the use of acid to reduce the pH. The composition is equally effective, however, in controlling corrosion in non-ferrous systems, particularly systems containing admiralty brass.

The present invention is further described in the following Example in which all parts are by weight unless otherwise indicated.

EXAMPLE 1

The effectiveness of the composition of this invention in controlling corrosion was determined by suspending mild steel and admiralty brass specimens in an aqueous environment of pH 8.7–9.3 designed to simulate the cooling water cycled in the towers of a cooling water system. An aqueous composition in accordance with this invention and identified as Composition A comprising 3% of nitrilotrimethylene phosphonic acid, 4% of 2-phosphonobutane tricarboxylic acid -1,2,4, 4.0% of tolyltriazole and 6.4% sodium molybdate was added to the aqueous environment as a corrosion inhibitor. Corrosion was measured against a control in mils of penetration per year(MPY) at two levels of concentration at the end of 72 hours. Results appear in Table I

TABLE I

| Composition | Corrosion Rate Mild Steel | (MPY) Admiralty |
|---|---|---|
| Control | 58.5 | 0.7 |
| Composition A (100 ppm) | 3.8 | 0.2 |
| Composition A (50 ppm) | 4.6 | 0.2 |

Similar corrosion control can be demonstrated when the three component system of Example 1 is varied in accordance with the disclosure.

Reference in this disclosure to details of the specific embodiments is not intended to restrict the scope of the claims which themselves recite those features regarded as essential to the invention.

We claim:

1. A composition for use in inhibiting corrosion of metallic surfaces including mild steel in an alkaline cooling water system in which the active components consist essentially of (a) 0.3–30% by wt. of nitrilotrimethylene phosphonic acid or a salt thereof; (b) 0.4–40% by wt. of 2-phosphonobutane tricarboxylic acid-1,2,4; (c) 0.4–40% by wt. of tolyltriazole; and (d) 0.5–50% by wt. of an alkali metal molybdate.

2. A method of inhibiting the corrosion of metallic surfaces including mild steel in an alkaline cooling water system which comprises incorporating in the cooling water an effective amount of a composition according to claim 1.

* * * * *